US008226271B2

(12) United States Patent
Mo

(10) Patent No.: US 8,226,271 B2
(45) Date of Patent: Jul. 24, 2012

(54) LED LAMP

(75) Inventor: Ci-Jin Mo, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 436 days.

(21) Appl. No.: 12/611,902

(22) Filed: Nov. 3, 2009

(65) Prior Publication Data

US 2011/0044038 A1 Feb. 24, 2011

(30) Foreign Application Priority Data

Aug. 18, 2009 (CN) ..... 2009 1 0305718

(51) Int. Cl.
*F21V 21/00* (2006.01)

(52) U.S. Cl. ..... 362/294; 362/249.02; 362/373; 362/247; 362/245; 362/243

(58) Field of Classification Search ..... 362/294, 362/373, 345, 264, 218, 126, 547, 580, 249.02, 362/247, 245, 243, 241, 545, 311.02, 235, 362/800

See application file for complete search history.

(56) References Cited

U.S. PATENT DOCUMENTS

| | | | | |
|---|---|---|---|---|
| 8,033,683 | B2 * | 10/2011 | Fields | 362/231 |
| 8,109,654 | B2 * | 2/2012 | Mo | 362/249.02 |
| 2006/0007012 | A1 * | 1/2006 | Machi et al. | 340/815.45 |
| 2006/0215408 | A1 * | 9/2006 | Lee | 362/294 |

* cited by examiner

*Primary Examiner* — Bao Q Truong

(74) *Attorney, Agent, or Firm* — Altis Law Group, Inc.

(57) ABSTRACT

An LED lamp includes a heat sink including a supporting plate, a plurality of LEDs mounted on the supporting plate and a light-reflecting member mounted on a top face of the supporting plate. The LEDs includes a plurality of first LEDs disposed on a bottom face of the supporting plate and a plurality of second LEDs disposed on the top face of the supporting plate and surrounding the light-reflecting member. The light-reflecting member defines a plurality of concave portions recessed inwardly from an outer face thereof. The second LEDs are located corresponding to the concave portions, respectively, whereby light generated from the second LEDs is reflected by the light-reflecting member towards a lateral side of the LED lamp.

17 Claims, 8 Drawing Sheets

LED LAMP

BACKGROUND

1. Technical Field

The disclosure relates to LED (light emitting diode) lamps for illumination purpose and, more particularly, relates to an improved LED lamp having a large illumination area.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Since LED lamps have many advantages; they are now used as street lamps, lawn lamps or home lamps for illumination purpose. Known implementations of an LED module in the LED lamp make use of a plurality of individual LEDs to generate light that is ample and of satisfactory spatial distribution. The large numbers of LEDs, however, increase price and power consumption of the module. Considerable heat is also generated, which, if not adequately addressed at additional expense, impacts the reliability of the LED lamp.

Further, since the LEDs are generally arranged on a printed circuit board having a flattened face, light emitted from the LEDs is concentrated on a small area confronting the LEDs due to high directivity of the LEDs, which is unsuitable for environments requiring an even and broad illumination. Thus, the LEDs mounted on the flattened face of the printed circuit board cannot have a large area of illumination.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
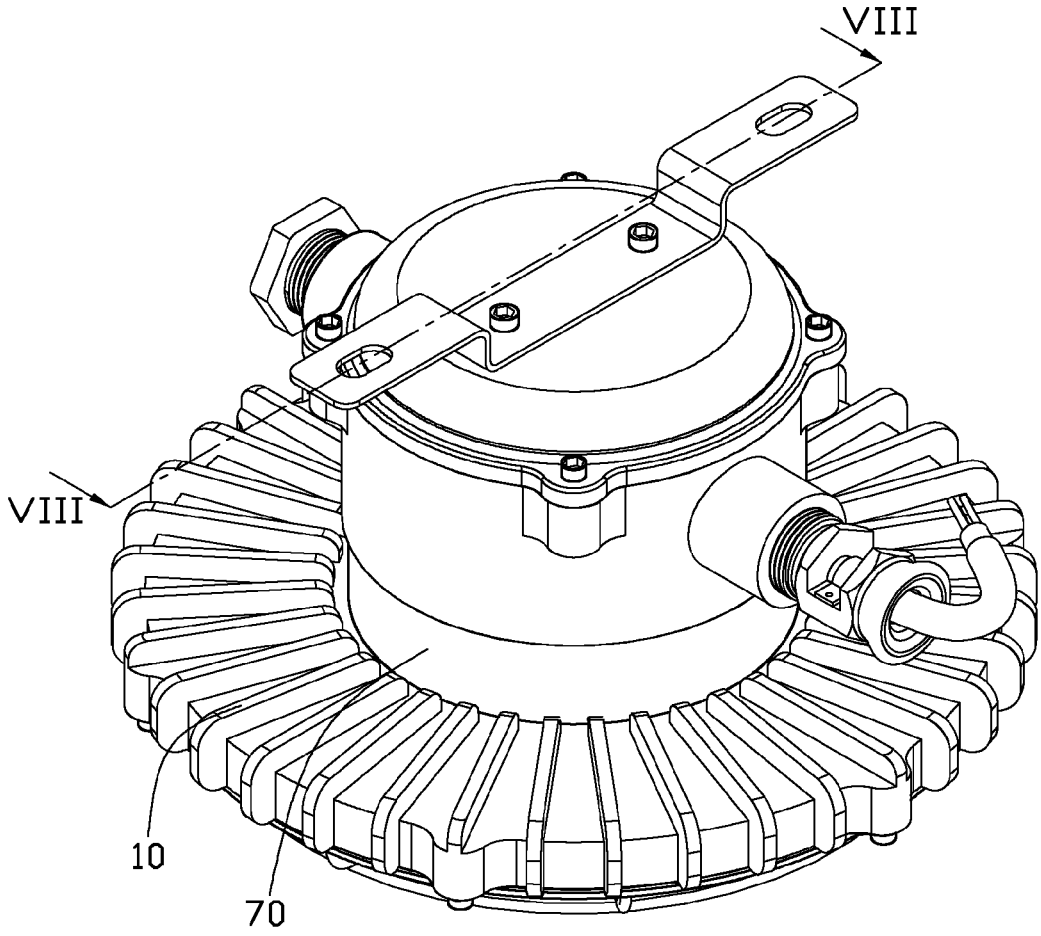
FIG. 1 is an isometric, assembled view of an LED lamp in accordance with an embodiment of the disclosure.
Figure 2:
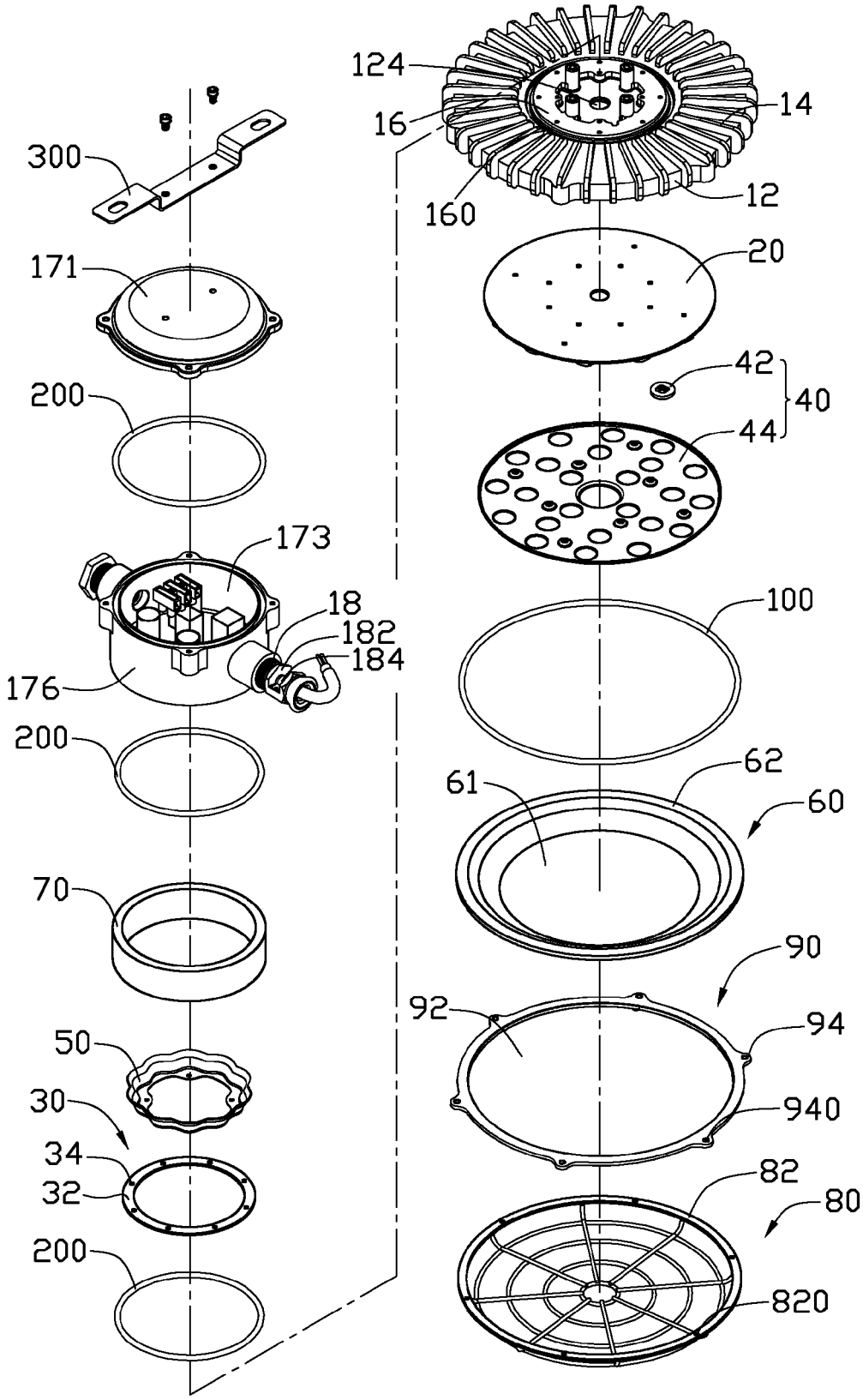
FIG. 2 is an exploded view of the LED lamp of FIG. 1.
Figure 4:
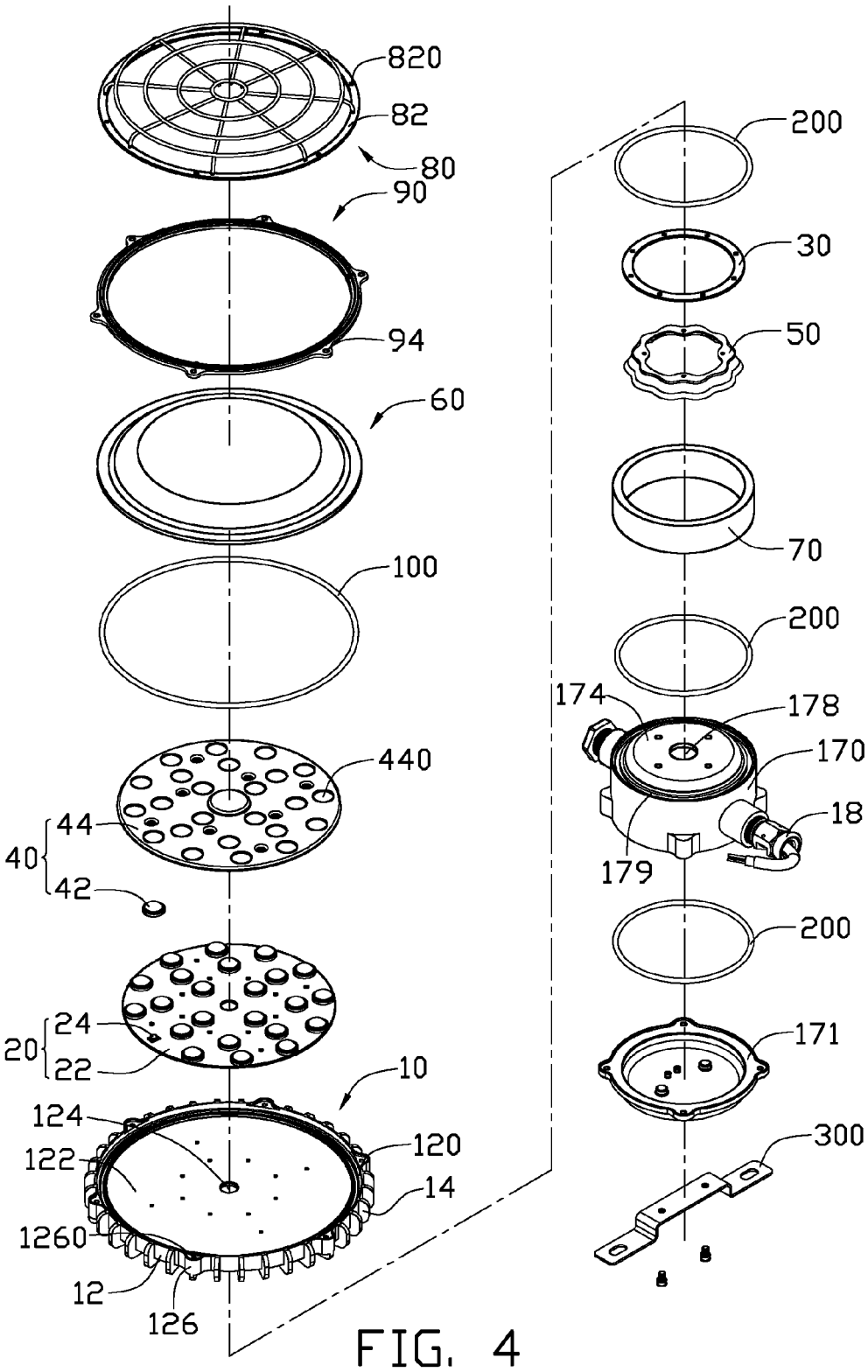
FIG. 4 is an exploded view of the LED lamp of FIG. 3.

Referring to FIGS. 1-2 and 4, a light emitting diode (LED) lamp in accordance with an embodiment of the disclosure is illustrated. The LED lamp comprises a heat sink 10, a first LED module 20 thermally attached to a bottom face of the heat sink 10, and a second LED module 30 thermally attached to a top face of the heat sink 10. A light-guiding member 40 is disposed on the first LED module 20. A light-reflecting member 50 is disposed on the top face of the heat sink 10. A first envelope 60 is mounted on the bottom face of the heat sink 10 and correspondingly covers the first LED module 20 and the light-guiding member 40. A second envelope 70 is mounted on the top face of the heat sink 10 and correspondingly encloses the second LED module 30 and the light-reflecting member 50 therein. A pressing frame 90 secures the first envelope 60 to the heat sink 10. A protecting cage 80 is secured to the pressing frame 90 to cover and protect the first envelope 60.

Figure 3:
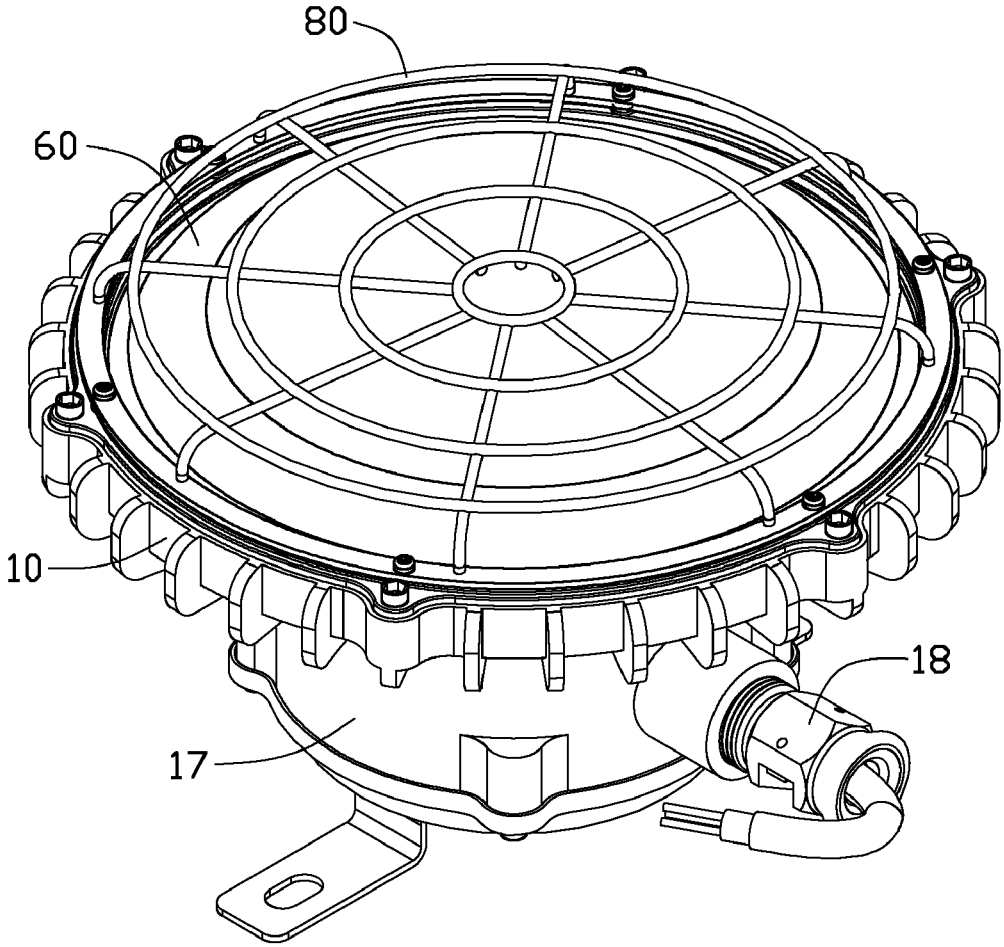
FIG. 3 is an inverted view of the LED lamp of FIG. 1.

Referring to FIG. 3 also, the heat sink 10 is integrally made of a metal with good heat conductivity such as aluminum, copper or an alloy thereof. The heat sink 10 comprises a circular supporting plate 12 and a plurality of fins 14 extending upwardly and outwardly from a top of the supporting plate 12. An annular receiving groove 120 is defined along an outer periphery of a bottom face of the supporting plate 12 for receiving an annular sealing gasket 100 therein. The first envelope 60 is mounted on the bottom face of the supporting plate 12 with a periphery of the first envelope 60 engaging with the sealing gasket 100 so that the first envelope 60 is hermetically connected to the supporting plate 12 of the heat sink 10. A circular protrusion 122 is formed at a central area of the supporting plate 12 and surrounded by the receiving groove 120. A through hole 124 is defined in a center of the protrusion 122 of the supporting plate 12 for extension of electrical wires (not shown) therethrough to electrically connect with the first LED module 20. An annular first groove 160 is defined at a center of a top face of the supporting plate 12 for receiving an annular sealing cushion 200 therein. The second envelope 70 is mounted on the top face of the supporting plate 12, with a periphery of the second envelope 70 engaging with the sealing cushion 200 whereby the second envelope 70 is hermetically connected to the supporting plate 12 of the heat sink 10. A circular engaging portion 16 is surrounded by the first groove 160 at the center of the top face of the supporting plate 12. The fins 14 are arranged radially relative to the engaging portion 16. A passage (not labeled) is defined between every two neighboring fins 14. A plurality of protruding ribs 126 protrude outwardly and perpendicularly from an outer circumference of the supporting plate 12. The protruding ribs 126 are equally spaced from each other. The protruding ribs 126 protrude radially outwardly and extend along a top-to-bottom direction of the supporting plate 12, and each have a semicircular cross-section along a horizontal direction. A screw hole 1260 is defined in a central portion of a bottom end of each protruding rib 126.

The first LED module 20 comprises a circular first printed circuit board 22 and a plurality of first LEDs 24 mounted on the first printed circuit board 22. The first printed circuit board 22 is thermally attached on the bottom face of the supporting plate 12 of the heat sink 10, and the first LEDs 24 are arranged evenly on the printed circuit board 22 and spaced from each other. It is understood that the first printed circuit board 22 is a base which can support the first LEDs 24 and electrically connect the first LEDs 24 to a power supply.

Figure 5:
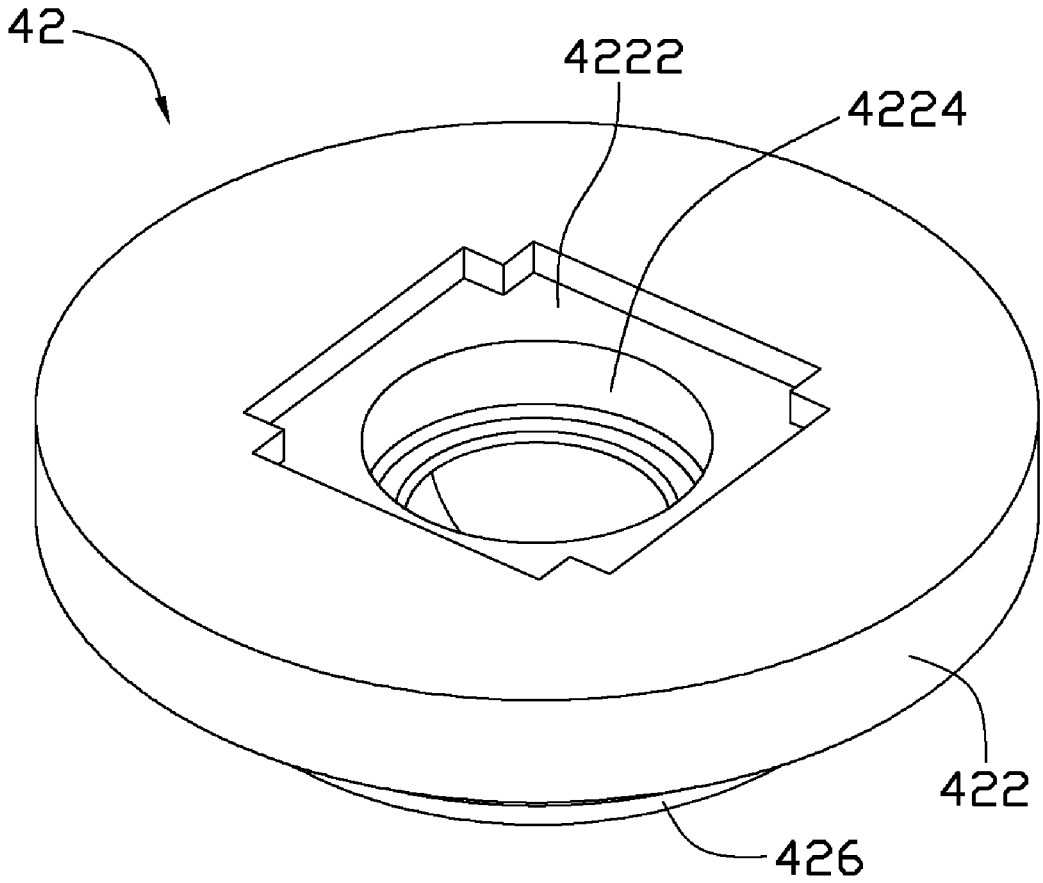
FIG. 5 is an enlarged view of a lens of the LED lamp of FIG. 2.
Figure 6:
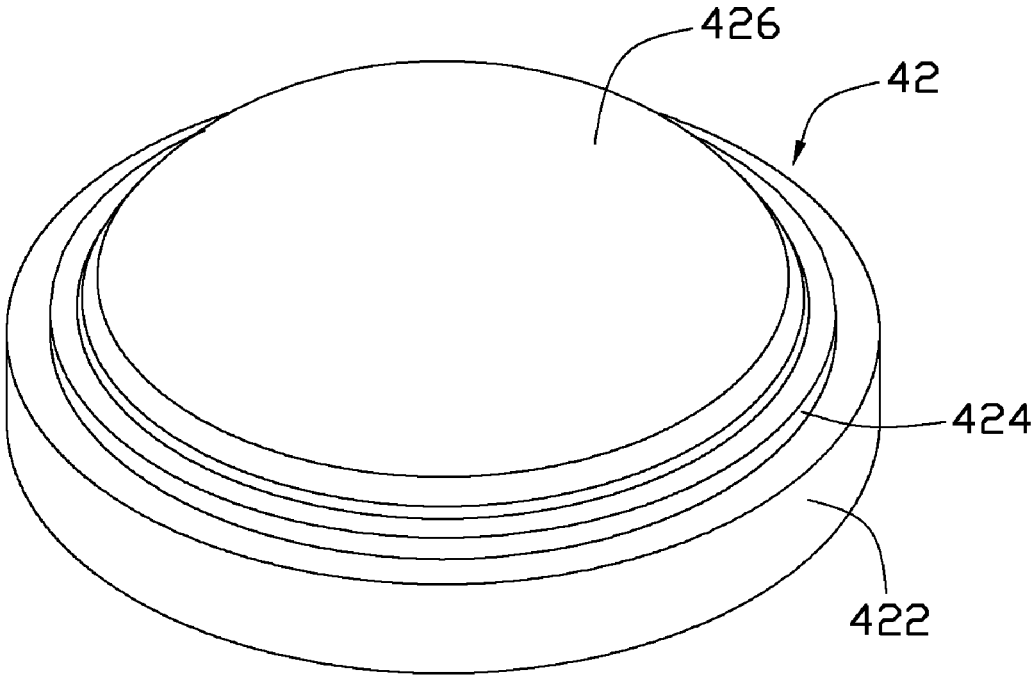
FIG. 6 is an inverted view of the lens of the LED lamp of FIG. 5.

Referring to FIGS. 5-6 also, the light-guiding member 40 comprises a plurality of lenses 42 each disposed on one of the first LEDs 24 of the first LED module 20 and a circular securing board 44 securing the lenses 42 to the first LED module 20. Each of the lenses 42 has a dome-like configuration and comprises a cylindrical supporting portion 422, an arced light-emitting portion 426 located at a center of a bottom of the supporting portion 422 and a cylindrical connecting portion 424 interconnecting the supporting portion 422 and the light-emitting portion 426. The lens 42 defines a crisscross groove 4222 recessed inwardly from a center of a top thereof for engagingly receiving a substrate (not labeled) of the first LED 24 therein. A hemispherical cavity 4224 is further recessed inwardly from a center of the crisscross groove 4222 for receiving an LED chip (not labeled) and an encapsulant of the first LED 24 therein. An inner face of the cavity 4224 is a spherical face and acts as a light incident face for the light generated by the first LED 24 entering into the lens 42. The securing board 44 defines a plurality of round fixing holes 440 for extension of the lenses 42 therethrough. A diameter of each fixing hole 440 is slightly larger than that of the connecting portion 424 of the lens 42, and smaller than that of the supporting portion 422 of the lens 42, whereby the light-emitting portion 426 of the lens 42 can extend through the fixing hole 440 while the supporting portion 422 would be confined below the securing board 44. In assembly, the supporting portion 422 of the lens 42 is sandwich between the securing board 44 and the first printed circuit board 22 of the first LED module 20, and the light-emitting portion 426 of the lens 42 extends though the securing board 44 and projects outwardly.

The second LED module 30 comprises an annular second printed circuit board 32 and a plurality of second LEDs 34 mounted on the second printed circuit board 22. The second printed circuit board 32 is thermally attached on the engaging portion 16 of the supporting plate 12 of the heat sink 10, and the second LEDs 34 are arranged evenly on the printed circuit board 32. The second LED module 30 is located close to a periphery of the engaging portion 16.

Figure 7:
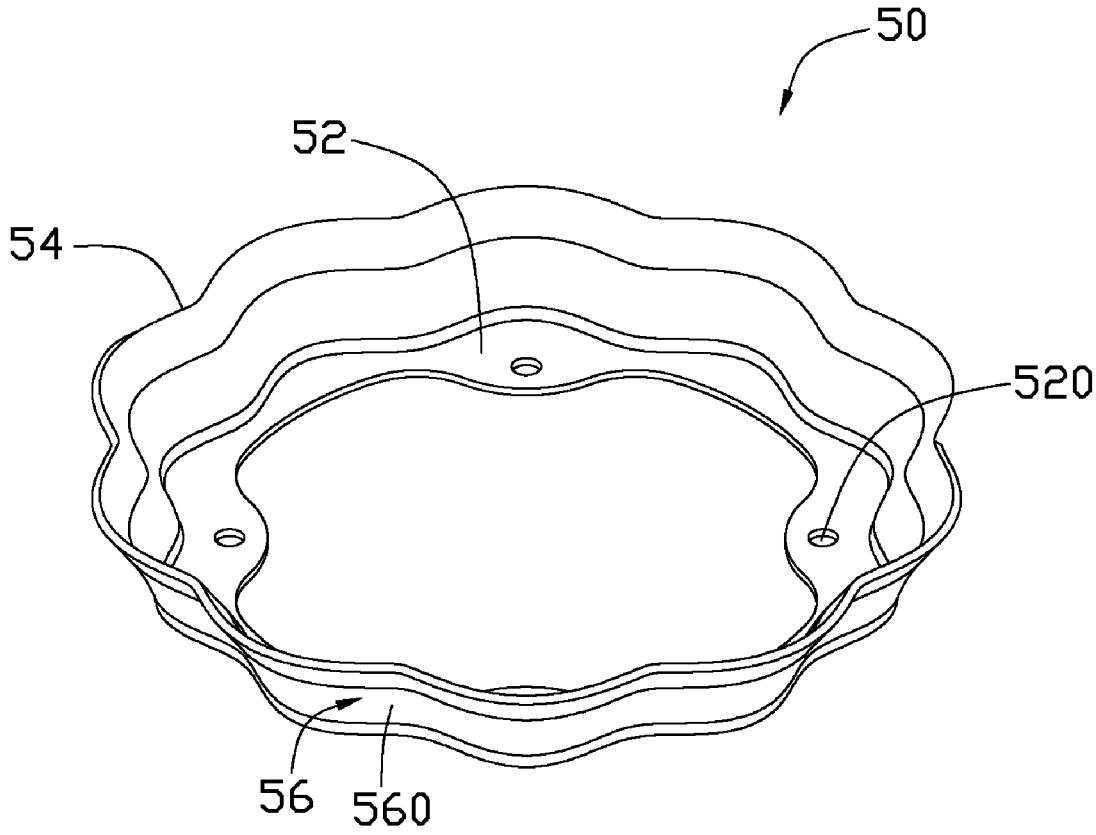
FIG. 7 is an enlarged view of a light-reflecting member of the LED lamp of FIG. 2.

Referring to FIG. 7 also, the light-reflecting member 50 is disposed on the engaging portion 16 of the supporting plate 12 and surrounded by the second LED module 30. The light-reflecting member 50 comprises a planar and annular seat 52 and a cylindrical reflecting portion 54 extending upwardly and outwardly from an outer circumference of the seat 52. A diameter of the reflecting portion 54 increases gradually away from the seat 52. An outer surface of the reflecting portion 54 faces the second LEDs 34. The outer surface of the reflecting portion 54 is configured to guide the light generated by the second LEDs 34 toward a surrounding environment of the LED lamp. A plurality of concave portions 56 are recessed inwardly from the outer surface of the reflecting portion 54, whereby the reflecting portion 54 has a waved shape. The concave portions 56 are spaced from each other, and each of the concave portions 56 is located corresponding to one second LED 34. Each concave portion 56 surrounds a corresponding part of each second LED 34. The seat 52 defines a plurality of thread holes 520 for a plurality of screws (not shown) extending therethrough and threadedly engaging into the engaging portion 16 to thereby secure the light-reflecting member 50 on the engaging portion 16.

Figure 8:
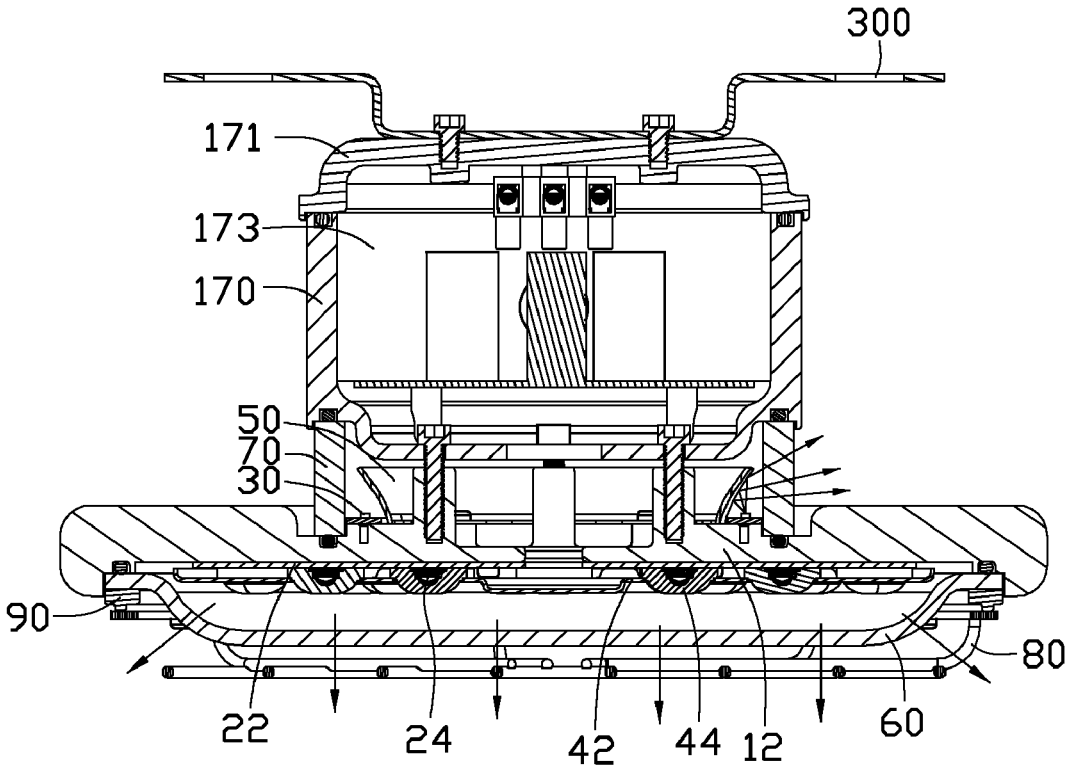
FIG. 8 is a cross-sectional view of the LED lamp of FIG. 1, taken along a line VIII-VIII thereof, with arrows indicating radiation directions of the light generated by the LED lamp.

The concave portions 56 of the light-reflecting member 50 each has a concave outer reflecting surface 560 facing the second LED 34. The outer reflecting surface 560 of each concave portion 56 correspondingly faces one second LED 34. The outer reflecting surface 560 can be a parabolic surface, a spherical surface, an aspheric surface, an elliptic surface or any other surface which can reflect and adjust the distribution of luminous intensity of the light generated by the second LEDs 34. In general, the outer reflecting surfaces 560 are for directing the light emitted from the second LEDs 34 to leave the LED lamp laterally and upwardly (better seen in FIG. 8).

The light-reflecting member 50 can be made of plastic or metallic material. According to practical requirement, the outer surface of the reflecting portion 54, especially the outer surfaces 560 of the concave portions 56, can be particularly treated to optimize light reflection of the light-reflecting member 50. For example, the outer surfaces 560 can be treated to be diffused, reflective surfaces by spraying or coating white reflecting material thereon, or highly reflective surfaces by plating a metallic coating thereon.

The first envelope 60 is integrally formed of a transparent or half-transparent material such as glass, resin or plastic. The first envelope 60 comprises a bowl-shaped body 61 and an engaging flange 62 extending outwardly and horizontally from a periphery of the top end of the body 61. The engaging flange 62 has a size larger than the receiving groove 120 of the supporting plate 12. When the first envelope 60 is connected to the heat sink 10, the engaging flange 62 covers the receiving groove 120, and the sealing gasket 100 is sandwiched between the engaging flange 62 and the supporting plate 12 for increasing the sealing performance of the LED lamp.

The pressing frame 90 is annular and defines a hole 92 at a center thereof. A plurality of spaced protruding tabs 94 extend radially and outwardly from an outer periphery of the pressing frame 90. The pressing frame 90 has a diameter substantially equal to that of the engaging flange 62 of the first envelope 60. The protruding tabs 94 are evenly distributed along a circumference of the pressing frame 90. Each of the protruding tabs 94 is about semicircular-shaped, and defines a securing hole 940 at a center thereof. The securing holes 940 of the protruding tabs 94 are aligned with the screw holes 1260 of the protruding ribs 126 of the heat sink 10, respectively. Fasteners (not shown) are brought to extend through the securing holes 940 and threadedly engage in the screw holes 1260 to thereby secure the pressing frame 90 to the heat sink 10.

The protecting cage 80 has a shape corresponding to that of the first envelope 60, and has a size slightly larger than the first envelope 60. The protecting cage 80 comprises a plurality of wires (not labeled) interlaced with each other. The protecting cage 80 is configured as a bowl-shaped mesh having a plurality of openings between the wires. A pressing flange 82 extends horizontally and outwardly from a top end of the protecting cage 80. A plurality of apertures 820 are defined along a circumference of the pressing flange 82. Fasteners (not shown) are extended through the apertures 820 into the pressing frame 90 to secure the protecting cage 80 to the pressing frame 90.

The second envelope 70 has a tubular shape with a through hole (not labeled) defined therein. Two opposite ends of the second envelope 70 each have a diameter similar to that of the first groove 160 of the heat sink 10. A bottom end of the second envelope 70 is fixed to the top face of the supporting plate 12 defining the first groove 160 and engages with the annular sealing cushion 200, whereby a hermetical connection between the bottom end of the envelope 70 and the supporting plate 12 of the heat sink 10 is attained. The second envelope 70 is made of a transparent or semitransparent material such as glass, plastic, etc., for allowing light emitted by the second LED module 30 passing therethrough.

A hollow mounting member 17 is disposed on a top end of the second envelope 70. The hollow mounting member 17 defines a receiving chamber 173 for accommodating a driving module (not labeled) therein. The second envelope 70 is sandwiched uprightly between the supporting plate 12 of the heat sink 10 and the mounting member 17. A safety connector 18 is further provided to the mounting member 17 for allowing electrical wires to extend therethrough into the receiving chamber 173. The mounting member 17 comprises a bowl-shaped main body 170 which defines an opening (not labeled) at a top thereof and a cover 171 disposed on the main body 170 and sealing the opening. The main body 170 comprises a circular bottom wall 174 and a cylindrical sidewall 176 extending perpendicularly and upwardly from an outer periphery of the bottom wall 174. A mounting hole (not labeled) is defined in one side of the sidewall 176 of the mounting member 17. An end of the safety connector 18 is threadedly engaged in the mounting hole. A connecting hole 178 is defined at a center of the bottom wall 174 of the main body 170 for extension of the electrical wires. An annular second groove 179 is defined at a bottom face of the main body 170 and along an outer circumference thereof. Another sealing cushion 200 is received in the annular second groove 179. The top end of the second envelope 70 is fixed to the bottom face of the main body 170 defining the annular second groove 179 and engages with the another sealing cushion 200. In other words, the another sealing cushion 200 is compressed between the second envelope 70 and the bottom wall 174 of the main body 170, whereby a hermetical connection between the top end of the second envelope 70 and the bottom wall 174 of the main body 170 is achieved.

The safety connector 18 is tubular and defines a central hole (not labeled) corresponding to the mounting hole for extension of the electrical wires. A cutout 182 is defined in one side of the safety connector 18 for receiving a pressing piece 184 therein. The cutout 182 communicates with the central hole (not labeled) for exposing a portion of the electrical wires received in the safety connector 18. The pressing piece 184 is arced, and defines two fixing holes (not labeled) at two opposite ends thereof. The pressing piece 184 is connected to the safety connector 18 via bolts (not shown) extending through the fixing holes thereof and screwing into the safety connector 18. The pressing piece 184 tightly secures the electric wires against an inner face of the safety connector 18, whereby the electrical wires are reliably held in the central hole via the pressing piece 184.

Referring to FIGS. 1-8 again, a fixing bracket 300 is disposed on the cover 171 of the mounting member 17. The fixing bracket 300 is an elongated and bended sheet, and comprises an upright U-shaped fixing portion (not labeled) which is fixed on the cover 171 and two arms (not labeled) extending outwardly and horizontally from two opposite sides of the fixing portion. In use, the LED lamp can be fixed to a wall or a ceiling via the fixing bracket 300.

In assembly, the first LED module 20 is mounted on the bottom face of the supporting plate 12; the second LED module 30 is attached to the top face of the supporting plate 12; the light-guiding member 40 is fixed to a bottom face of the printed circuit board 22 with the first LEDs 24; the engaging flange 62 of the first envelope 60 is hermetically connected to the bottom face of the supporting plate 122 defining the receiving groove 120 of the heat sink 10 to receive the first LED module 20 and the light-guiding member 40 therein; the second envelope 70 is hermetically sandwiched between the heat sink 10 and the mounting member 17 to thereby receive the second LED module 30 and the light-reflecting member 50 therein; the pressing frame 90 is disposed on the first envelope 60 and fixed to the heat sink 10 to press the first envelope 60 against the heat sink 10, wherein the protruding tabs 94 of the pressing frame 90 horizontally protrude outside of the engaging flange 62 and located just above the protruding ribs 126, respectively; the protecting cage 80 surrounds an outer periphery of the first envelope 60 with the pressing flange 82 thereof securely fixed to the pressing frame 90.

The above-described LED lamp can be applied in various occasions to meet large-area illumination requirements thereof. For example, the LED lamp could be secured to a ceiling via the fixing bracket 300. The light generated by the first LED module 20 is directly transmitted through the light-guiding member 40 and the first envelope 60 toward an area below the lamp, and projects outwardly, as indicated by the downwardly pointing arrows in FIG. 8. The lenses 42 of the light-guiding member 40 can exactly refract the light from the first LEDs 24 towards the predefined area to be illuminated, whereby utilization efficiency of the LED light source is thus enhanced. The light generated by the second LED module 30 is reflected by the outer surface of the reflecting portion 54, especially the outer surfaces 560 of the concave portions 56, and then through the second envelope 70 towards the surrounding environment of the LED lamp, as indicated by the laterally pointing arrows in FIG. 8. Thus, the first and second LED modules 20, 30 of the LED lamp can generate light that radiate along multiple directions, i.e., along the downward direction and the lateral direction, to thereby provide a large-area illumination. Thus, the LED lamp in accordance with present disclosure can have a large illumination area.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a heat sink comprising a supporting plate;

a plurality of LEDs mounted on the supporting plate, and the LEDs comprising a plurality of first LEDs disposed on a bottom face of the supporting plate and a plurality of second LEDs disposed on a top face of the supporting plate; and a light-reflecting member mounted on the top face of the supporting plate and surrounded by the second LEDs, and the light-reflecting member defining a plurality of concave portions recessed inwardly from an outer face thereof;

wherein the second LEDs are located corresponding to the concave portions, respectively, whereby light generated from the second LEDs is reflected by the light-reflecting member towards a lateral side of the LED lamp.

2. The LED lamp as described in claim 1 further comprising a light-guiding member disposed over the first LEDs, the light-guiding member comprising a plurality of lenses each disposed over one of the first LEDs and a securing board securing the lenses in position over the first LEDs.

3. The LED lamp as described in claim 2, wherein each of the lenses has a dome-like configuration and comprises a cylindrical supporting portion and an arced light-emitting portion located at a center of a bottom of the supporting portion.

4. The LED lamp as described in claim 3, wherein the securing board defines a plurality of round fixing holes for extension of the lenses, and a diameter of each fixing hole is slightly larger than that of the light-emitting portion of the lens, and smaller than that of the supporting portion of the lens.

5. The LED lamp as described in claim 2, wherein each of the lens defines a crisscross groove recessed inwardly from a center of a top thereof for engagingly receiving a corresponding one of the first LEDs therein and a hemispherical cavity further recessed inwardly from a center of the crisscross groove for receiving the corresponding one of the first LEDs therein.

6. The LED lamp as described in claim 1, wherein a diameter of the light-reflecting member gradually increases along an upward direction from the top face of the supporting plate.

7. The LED lamp as described in claim 1, wherein the concave portions are spaced from each other and distributed evenly along an outer circumference of the light-reflecting member.

8. The LED lamp as described in claim 1, wherein the light-reflecting member comprises a planar and annular seat horizontally attached to the top face of the supporting plate, and a cylindrical reflecting portion extending upwardly from the seat.

9. The LED lamp as described in claim 8, wherein the reflecting portion has a waved configuration.

10. The LED lamp as described in claim 1, wherein each concave portion of the light-reflecting member partially surrounds one of the second LEDs, whereby the light generated by the one of the second LEDs can be reflected by the each concave portion.

11. The LED lamp as described in claim 1, wherein each of the concave portions has a concave outer reflecting surface facing one of the second LEDs, and the outer reflecting surface of each concave portion is one of a parabolic surface, a spherical surface, an aspheric surface and an elliptical surface.

12. The LED lamp as described in claim 1, wherein an annular receiving groove is recessed from a periphery of the bottom face of the supporting plate.

13. The LED lamp as described in claim 12 further comprising a first envelope which comprises a bowl-shaped body and an engaging flange extending outwardly from a periphery of the body, and the engaging flange is fixed to the bottom face of the supporting plate of the heat sink defining the receiving groove.

14. The LED lamp as described in claim 13 further comprising an annular pressing frame disposed on the engaging flange of the first envelope for securing the first envelope to the heat sink.

15. The LED lamp as described in claim 13 further comprising a protecting cage covering an outer face of the first envelope, the protecting cage comprising a plurality of wires interlaced with each other.

16. The LED lamp as described in claim 1 further comprising a mounting member for receiving a driving module therein.

17. The LED lamp as described in claim 16 further comprising a tubular second envelope disposed on the top face of the supporting plate and enclosing the second LED module and the light-reflecting member therein, wherein the second envelope is hermetically sandwiched between the supporting plate and the mounting member.

* * * * *